United States Patent [19]

Tai et al.

[11] 4,375,902

[45] Mar. 8, 1983

[54] LOCKING HEADREST FOR DENTAL CHAIR

[75] Inventors: Harold Y. Tai, Everett; Floyd E. Norris, Seattle, both of Wash.

[73] Assignee: Royal Dental Manufacturing, Inc., Everett, Wash.

[21] Appl. No.: 191,367

[22] Filed: Sep. 29, 1980

Related U.S. Application Data

[63] Continuation-in-part of Ser. No. 69,096, Aug. 23, 1979, abandoned.

[51] Int. Cl.[3] ..... A47C 7/10

[52] U.S. Cl. ..... 297/408; 297/391

[58] Field of Search ..... 297/408, 409, 391, 345, 297/410; 248/410; 108/146, 148, 67

[56] References Cited

U.S. PATENT DOCUMENTS

| | | | |
|---|---|---|---|
| Re. 29,811 | 10/1978 | Norris | 297/408 |
| 156,846 | 11/1874 | Fiske | 297/408 |
| 532,676 | 1/1895 | Lovejoy | 297/78 X |
| 836,303 | 11/1906 | Christensen | 248/410 |
| 1,505,474 | 8/1924 | Laraia | 297/408 |
| 1,618,773 | 2/1927 | Meyers | 188/67 X |
| 1,674,081 | 6/1928 | Adams | 248/410 |
| 2,392,477 | 1/1946 | Holm | 108/146 |
| 2,637,313 | 5/1953 | White | 248/410 X |
| 3,302,971 | 2/1967 | Lory | 297/346 |
| 3,486,789 | 12/1969 | Taylor et al. | 297/78 |
| 3,497,259 | 2/1970 | Sherfey | 297/408 X |
| 3,514,153 | 5/1970 | Maurer et al. | 297/330 X |
| 3,536,355 | 10/1970 | Osbeck | 297/71 |
| 3,547,486 | 12/1970 | Herzer | 297/408 |
| 3,588,023 | 6/1971 | Cohen | 248/410 |
| 3,804,460 | 4/1974 | Leffler | 297/330 |
| 4,113,309 | 9/1978 | Brockway | 297/408 |
| 4,128,274 | 12/1978 | Schmedemann | 297/410 |

*Primary Examiner*—James T. McCall

*Attorney, Agent, or Firm*—Dowrey & Cross

[57] ABSTRACT

A dental chair headrest which may be positioned and locked in a predetermined angular orientation relative to the seat back. A support base allows height adjustment and has a headrest frame pivotally connected thereto. The locking mechanism includes a locking shaft pivotally connected to the support base and extending through a bore within a locking block pivotally connected to the headrest frame. Alignment of the locking shaft and bore allows the adjustment of the headrest angle, and pivoting the locking block engages the edges of the bore with the surface of the locking shaft to retain the locking shaft in a predetermined position within the bore. The headrest is covered by a resilient material, and a positioning lever extends from the locking block to a location where the positioning lever may be actuated by pressure on the resilient material to disengage the locking block from the locking shaft.

21 Claims, 9 Drawing Figures

FIG. 3
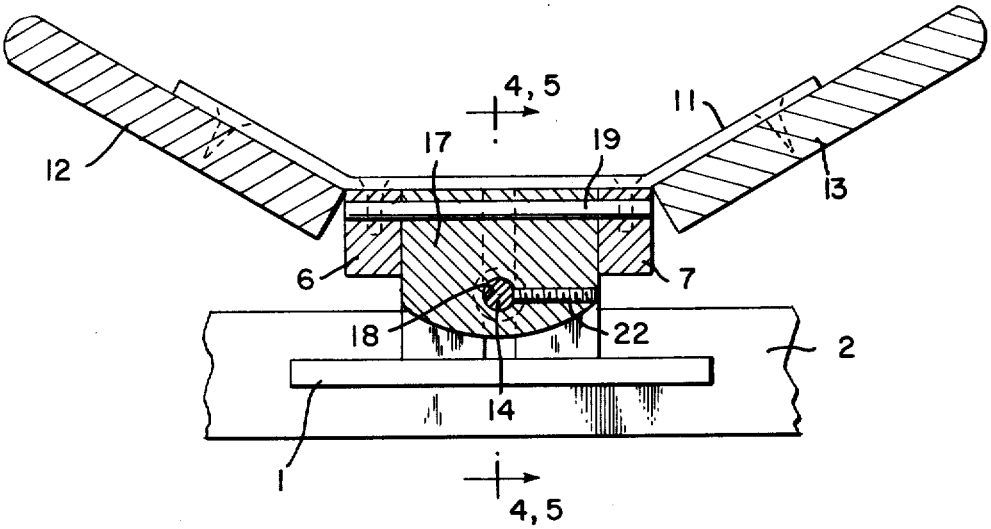
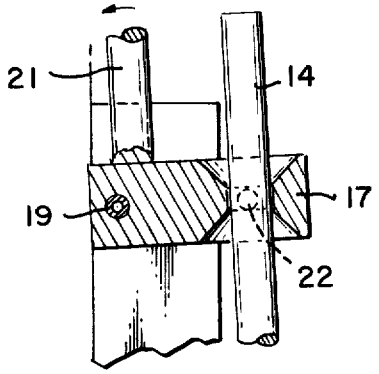
FIG. 4
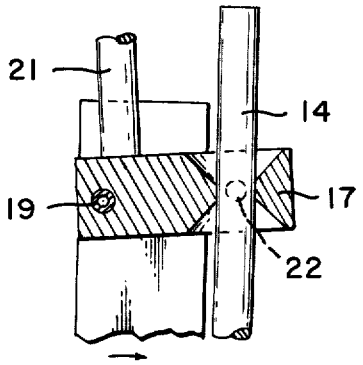
FIG. 5
FIG. 6
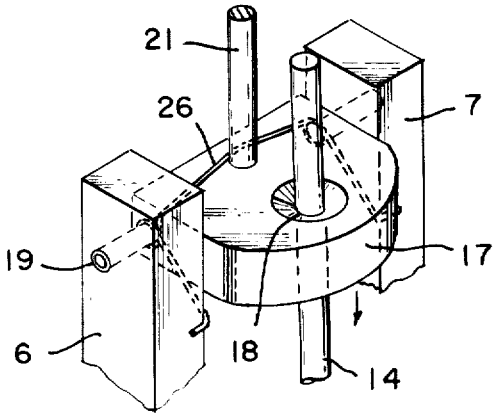

LOCKING HEADREST FOR DENTAL CHAIR

CROSS REFERENCE TO RELATED APPLICATION

This application is a continuation-in-part of applicants' prior co-pending application Ser. No. 69,096 filed Aug. 23, 1979, now abandoned.

BACKGROUND OF THE INVENTION

1. Field of the Invention

This invention relates generally to headrests for chairs and, more particularly, to a dental chair headrest which may be positioned and locked in a predetermined location.

2. Description of the Prior Art

Placing a patient in the most advantageous position for a given dental treatment is greatly facilitated by having a dental chair with an adjustable headrest; however, many prior art adjustable dental chair headrests are expensive, cumbersome and have mechanisms exposed to the rear of the headrest. Therefore, the prior art shows a need for a dental chair headrest having a height adjustment relative to the seat back and having an inexpensive, convenient and reliable mechanism for adjusting and locking the angle of the headrest relative to the seat back to enable a dental chair to accommodate different head sizes and to enable a dentist to place a patient in the position desired for a given treatment. Having the mechanisms covered would preclude the necessity of cleaning the mechanisms and would improve the visual appearance of the dental chair.

SUMMARY OF THE INVENTION

The present invention overcomes the difficulties associated with prior art dental chair headrests by providing a covered dental chair headrest having a height adjustment and having an adjustable angular position relative to the seat back. A dental chair headrest according to the present invention is pivotally connected to a support base which is slideably mounted to the seat back of a dental chair. A locking shaft has one end thereof pivotally connected to the support base and the other end thereof extending through a locking block having a bore therein with the diameter of the bore being slightly larger than the diameter of the locking shaft. The locking block is pivotally mounted between first and second headrest support members which are pivotally mounted to the support base, and the angular position of the headrest relative to the support base is adjustable whenever the locking block is pivoted to align the bore with the locking shaft. A positioning lever is mounted to the locking block so that a force may be applied to the positioning lever to align the bore and the locking shaft. When the headrest is in the desired angular position, the positioning lever is released; and the headrest is pulled back, which engages the edges of the bore against the locking shaft to hold the locking shaft in a predetermined position within the bore.

Headrests are attached to headrest support arms mounted transversely on the headrest support members, and the entire headrest is covered with a resilient material. The headrest covering material is resilient to enhance patient comfort and to enable actuation of the positioning lever through the covering material by a gentle application of pressure.

Accordingly, the present invention provides a dental chair headrest which may be placed and locked in a predetermined angular position relative to a dental chair seat back. The adjusting and locking mechanisms are covered by the headrest covering material and are operated by application of pressure to the locking mechanism through the headrest covering material.

BRIEF DESCRIPTION OF THE DRAWINGS

FIG. 3 is a horizontal cross sectional view of the locking mechanism;

FIG. 4 is a vertical cross sectional view of the locking mechanism in the unlocked position;

FIG. 5 is a vertical cross sectional view of the locking mechanism in the locked position;

FIG. 6 is a perspective view of an alternative locking mechanism;

DESCRIPTION OF THE PREFERRED EMBODIMENT

Figure 1:
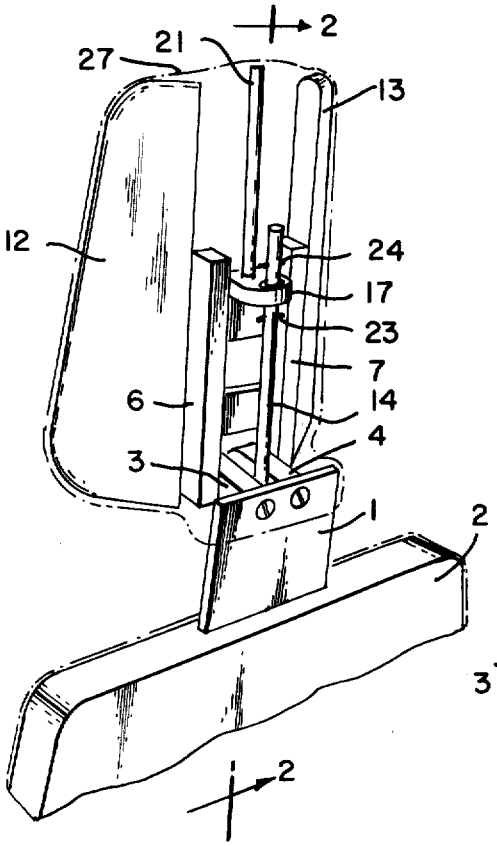
FIG. 1 is a rear perspective view of the headrest of the present invention.
Figure 2:
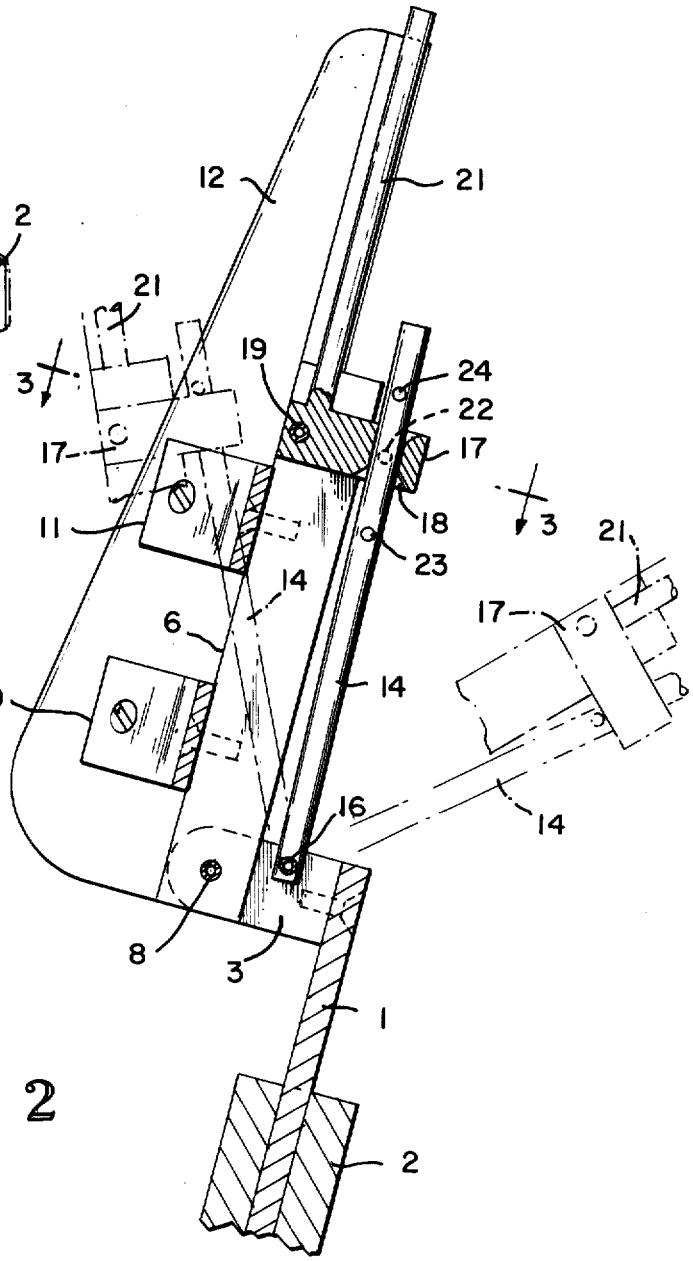
FIG. 2 is a partially sectioned side elevational view of the headrest invention.

Referring to FIGS. 1 and 2, a support base 1 for attaching a headrest to a dental chair 2 is shown extending into the seat back of the dental chair 2 to which the support base 1 is slideably mounted. The support base 1 is a flat, elongated, generally rectangular shape with a pair of support arms 3 and 4 extending approximately perpendicularly therefrom. The headrest frame includes first and second support members 6 and 7 pivotally connected to the support arms 3 and 4 by a pin 8 and first and second cross arm members 9 and 11 mounted transversely to the parallel support members 6 and 7 near opposite ends thereof. The cross arm members 9 and 11 are curved outwardly as shown in FIG. 3, and first and second head supports 12 and 13 are mounted thereto in order to form a headrest suitably configured to cup the head of the patient.

Referring to FIGS. 1 and 2, the headrest has a locking mechanism which includes a locking shaft 14 which is pivotally connected to the first and second support arms 3 and 4 by a pin 16 at a location spaced apart from pin 8 where the first and second support members 6 and 7 are mounted to the support arms 3 and 4. The locking shaft 14 extends through a locking block 17 which has a bore 18 extending therethrough with the diameter of the bore 18 being slightly larger than the diameter of the locking shaft 14. Therefore, the locking shaft 14 is slideable within the bore 18 whenever the locking shaft 14 is properly aligned with the bore 18. The locking block 17 is pivotally mounted on the first and second support members 6 and 7 by a pin 19, and the difference between the diameters of the locking shaft 14 and the bore 18 allows the locking block 17 to have a range of pivotal motion about the pin 19 sufficient to engage the upper and lower edges of the bore 18 upon the locking shaft 14 whenever it is desired to lock the headrest in position.

A positioning lever 21 is mounted to the locking block 17 to facilitate pivotal motion of the locking block 17 about its pivot point 19. As shown in FIG. 4, alignment of the locking shaft 14 with the bore 18 allows the locking shaft 14 to slide easily through the bore 18; but as shown in FIG. 5, pivoting the locking block 17 so that the locking shaft 17 and the bore 18 are out of alignment causes the upper and lower edges of the bore to engage the locking shaft 14 to lock the headrest in a predetermined position. The upper and lower edges of the bore 18 may be engaged with the surface of the locking shaft 14 by actuating the positioning lever 21 to rotate the locking block 17 or by attempting to pivot the support members 6 and 7 about pin 8. As shown in FIG. 3 a set screw 22 provides an adjustable force on and exerts a frictional drag upon the locking shaft 14. Alternately a spring could be interposed between the shaft 14 and set screw 22 to exert an adjustable frictional drag upon the locking shaft 14. Referring again to FIGS. 1 and 2, the range of motion of the locking shaft 14 through the locking block 17 is limited by a pair of stops 23 and 24.

Referring to FIG. 6, there is shown an alternate embodiment of the invention including means for providing locking in one direction. A spring 26 engages the support members 6 and 7 and the pin 19 to exert a force upon the positioning lever 21 which tends to rotate the locking block 17 counterclockwise to maintain engagement of the edges of the bore 18 with the surface of the locking shaft 14. Therefore, unlocking the mechanism requires the application of a force opposite to the spring bias to align the bore 18 with the locking shaft 17.

The headrest and the locking mechanism are covered by a soft resilient material 27 which prevents the internal mechanical components of the headrest from becoming dirty and which enhances patient comfort and the aesthetic appearance of the headrest. An end of the positioning lever 21 extends from the locking block 17 to a location closely adjacent the headrest covering material 27 so that the positioning lever 21 may be actuated by an application of pressure to the outer surface of the headrest covering material 27 near the end of the positioning lever 21.

Figure 8:
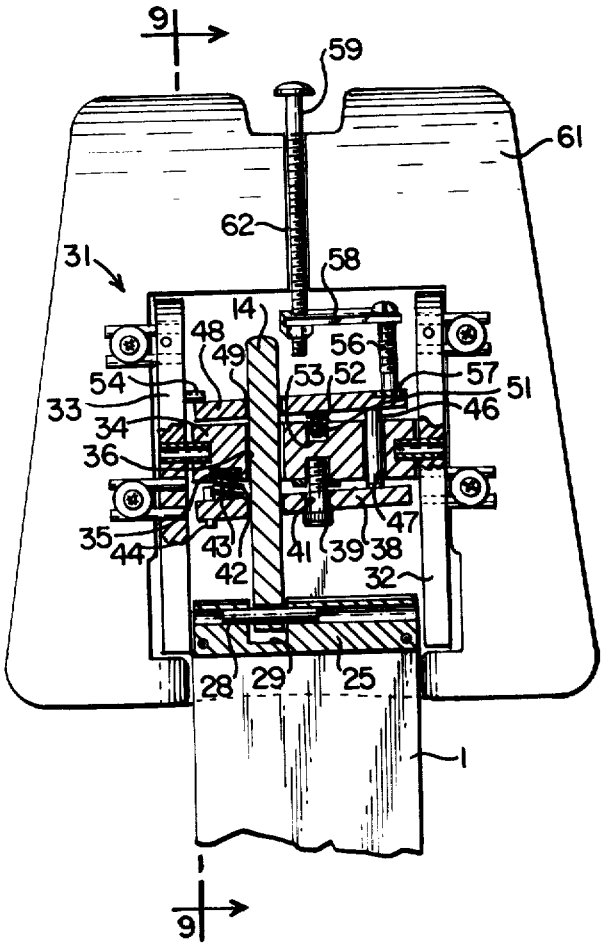
FIG. 8 is a partially sectioned view of the embodiment of FIG. 7.
Figure 9:
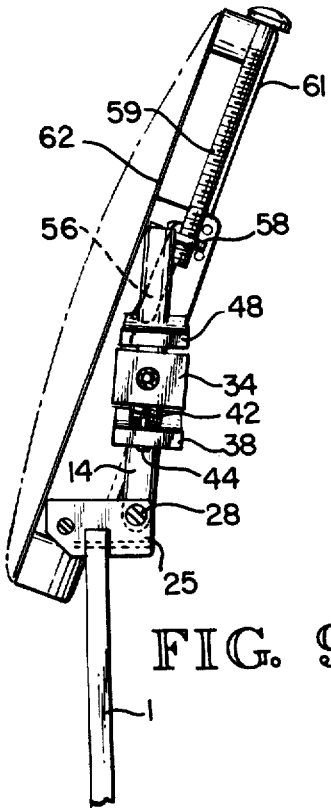
FIG. 9 is a cross sectional view taken along line 9—9 of FIG. 8.
Figure 7:
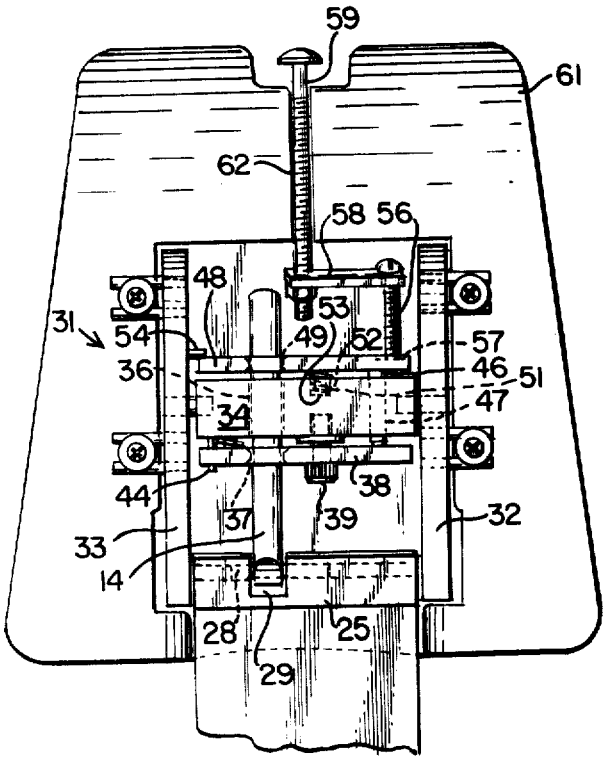
FIG. 7 is a rear elevation view of a second embodiment of the invention.

Referring to FIGS. 7-9, there is shown a second embodiment of the invention. The support base 1 has a support block 25 mounted to an end thereof; and a pivot pin 28 pivotally mounts the locking shaft 14 in a slot 29 in the support block 25. The headrest frame indicated generally by reference numeral 31 includes a first support member 32 and a second support member 33 which are pivotally mounted to the support block 25 on opposite ends thereof. A guide block 34 is mounted between the support members 32 and 33; and the locking shaft 14 extends through a bore 36 within the guide block 34 to guide and support the central portion of the locking shaft 14.

The locking shaft 14 also passes through a first locking bore 37 in a first locking plate 38 which is connected to the guide block 34 by a bolt 39 which passes through a bore 41 within the locking plate 38. The diameter of the bore 41 is slightly larger than that of the bolt 39, and the diameter of the locking bore 37 is slightly larger than that of the locking shaft 14 to permit the locking plate 38 to have a range of motion about the locking shaft 14 and the bolt 39. A spring 42 has one end thereof mounted in a recess 35 in the guide block 34; and apeg 43 retains the other end of the spring 42 against the locking plate 38 such that the spring 42 provides a biasing force to keep the locking plate 38 out of alignment with the locking shaft 14 such that an edge of the locking bore 37 engages the locking shaft 14 to prevent pivotal motion thereof in the counterclockwise direction as viewed in FIG. 9. A second peg 44 extends from the locking plate 38 adjacent the peg 43 to limit the range of motion of the locking plate 38 such that when a force is applied to the locking plate to overcome the spring bias, the locking plate 38 will rotate only enough to align the locking bore 37 with the locking shaft 14 without engaging the locking shaft 14 against the locking bore 37 to prevent pivotal motion in the clockwise direction.

A pin 46 extends through a bore 47 within the guide block 34 between the first locking plate 38 and a second locking plate 48. The locking shaft 14 extends through a second locking bore 49 within the second locking plate 48 with the diameter of the second locking bore 49 being slightly larger than the diameter of the locking shaft 14 to allow the second locking plate 48 to have a range of motion about the locking shaft 14. A spring 51 mounted on a peg 52, which extends from the second locking plate 48, extends into a recess 53 within the guide block 34 to provide a biasing force between the second locking plate 48 and the guide block 34 such that an edge of the second locking bore 49 engages the locking shaft 14 to prevent pivotal motion thereof in the clockwise direction as seen in FIG. 9. A peg 54 extends from the support member 33 to provide a pivot point for the second locking plate 48 when a force is applied to oppose the biasing force of the spring 51 to align the second locking bore 49 with the locking shaft 14.

A bolt 56 extends into a recess 57 within the second locking plate 48; and a plate 58 connects the bolt 56 to a second bolt 59. Application of a force to move the bolt 59 toward the second locking plate 48 presses the bolt 56 against a recess 57 therein. The force is transmitted from the second locking plate 48 to the first locking plate 38 by the pin 46; and application of a force sufficient to move the locking blocks 38 and 48 such that the peg 44 touches the guide block 34 aligns both the first locking bore 37 and the second locking bore 49 with the locking shaft 14 to permit free pivotal motion thereof about the pivot pin 28. When the unlocking force is removed from the bolt 59, the biasing forces of the springs 42 and 51 again engage the first locking bore 37 and the second locking bore 49 with the locking shaft 14 to prevent pivotal motion thereof in either direction.

The headrest shown in FIGS. 7-9 includes a head support 61 suitably mounted to the frame 31. The bolt 59 extends through a passage 62 in the head support 61 such that a force which moves the head of the bolt 59 toward the passage 62 aligns the locking plates 38 and 48 to permit adjustment of the angular position of the headrest.

Although the present invention has been described with reference to a particular embodiment thereof, it will be understood by those skilled in the art that numerous modifications may be made without departing from the scope of the invention. Accordingly, all modifications and equivalents which are properly within the scope of the appended claims are included in the present invention.

What is claimed is:

1. A headrest for a chair, comprising:

support means for attaching said headrest to a chair;

a headrest frame pivotally connected to said support means;

a locking block pivotally connected to said headrest frame, said locking block having a bore extending therethrough;

a locking shaft having one end thereof pivotally connected to said support means and the other end thereof extending through said bore, said locking shaft having a diameter smaller than the diameter of said bore, said locking shaft being slidable within said bore when aligned therewith; and means for engaging an edge of said locking of block adjacent said bore against the surface of said locking shaft to lock said locking shaft in a predetermined position within said bore.

2. A headrest for a chair according to claim 1 including a positioning lever mounted to said locking block for pivoting said locking block relative to said locking shaft to align said shaft in said bore to permit angular positioning of said headrest.

3. A headrest for a chair according to claim 2 further including:

head support means for supporting a person's head thereon; and a resilient material covering said head support means and said positioning lever, said positioning lever located closely adjacent said resilient material whereby said positioning lever may be actuated by pressure applied to said resilient material at a location proximate said positioning lever.

4. A headrest for a chair according to claim 1 wherein said support means is slideably mounted for vertical adjustment relative to said chair.

5. A headrest for a chair according to claim 1 wherein said chair is a dental chair.

6. A headrest for a chair according to claim 1 wherein said angular position is infinitely adjustable within a predetermined range.

7. A headrest for a chair, comprising:

support means for attaching said headrest to a chair;

a headrest frame pivotally connected to said support means;

a locking shaft having one end thereof pivotally connected to said support means;

locking means connected to said headrest frame for receiving said locking shaft, said locking means including means forming a bore therein for receiving said locking shaft;

said locking shaft having a diameter smaller than the diameter of said bore and being slidable therein when aligned therewith; and means for engaging an edge of said bore forming means against the surface of said locking shaft to lock the locking shaft in a predetermined position within said bore.

8. The headrest according to claim 7 wherein said bore forming means comprises:

a locking block pivotally connected to said headrest frame and forming a bore said locking shaft extending through the bore in said locking block and being slidable therein when aligned therewith.

9. The headrest according to claim 7 wherein said locking means includes:

a guide block pivotally connected to said headrest frame and forming a guide bore extending therethrough for slidably receiving said locking shaft and wherein said bore forming means comprises a locking plate operatively associated with said guide block and forming a bore extending therethrough, said means for engaging an edge of said bore forming means against said locking shaft including spring biasing means acting between said guide block and said locking plate to maintain the bore out of alignment with said locking shaft.

10. The headrest according to claim 8 wherein said locking means further includes a second locking plate operatively associated with said guide block and forming a second bore therein for receiving said locking shaft; and second spring biasing means for maintaining said second bore formed by said second locking plate out of alignment with said locking shaft in the opposite direction from said first locking plate, whereby said locking shaft is locked against sliding movement in said guide block in both directions.

11. The headrest according to claim 10 including:

selectively operable release means carried by said headrest for simultaneously aligning said first and second bores formed by said first and second locking plates with said locking shaft, whereby said headrest may be selectively moved to a desired pivotable position and locked against movement in either direction.

12. A headrest comprising:

support means;

headrest frame means pivotably connected to said support means;

an elongated locking member pivotably connected to said support means; and locking means carried by said headrest for selectively engaging said frame means with said elongated member whereby said headrest frame means is locked in a fixed angular position relative to the support means.

13. The headrest of claim 12 wherein said locking means includes:

means forming a bore for receiving said elongated member, at least one cross-sectional dimension of said bore being greater than the corresponding dimension of the elongated member; and means for pivotally connecting said bore forming means to said frame means, said bore forming means including an edge adjacent the periphery of the bore for engaging said elongated member to lock said frame means in a fixed angular position.

14. The headrest of claim 13 wherein said locking means further includes spring means for biasing said edge into engagment with said elongated member.

15. The headrest of claim 13 wherein said bore forming means includes means for frictionally engaging said elongated member.

16. The headrest of claim 14 or 15 including means connected to said bore forming means for transmitting a force thereto to disengage said edge with said elongated member whereby said locking means is released from engagement with said elongated member to unlock said headrest frame means.

17. The headrest of claim 12 wherein said locking means includes first and second locking members acting between said frame means and said elongated member, each such locking member forming a bore for receiving said elongated member and including an edge adjacent the periphery of said bore for selectively engaging said elongated member.

18. The headrest of claim 17 further comprising means acting between said first and second locking members for transmitting a force therebetween.

19. The headrest of claim 18 further comprising guide means forming a bore for slideably supporting said elongated member, said guide means being pivotably connected to said frame means.

20. The apparatus of claim 19 further comprising means for biasing said first and second locking members into locking engagement with said elongated member.

21. The apparatus of claim 20 further comprising means connected to at least one of said first and second locking members for transmitting a force thereto to disengage said edge from said elongated member whereby said locking means is released from engagement with said elongated member to unlock said headrest frame means.

* * * * *